US008425437B2

(12) United States Patent
Zaborowski

(10) Patent No.: US 8,425,437 B2
(45) Date of Patent: Apr. 23, 2013

(54) PHYSICAL REHABILITATION APPARATUS

(76) Inventor: Abel B. Zaborowski, Chicago, IL (US)

( * ) Notice: Subject to any disclaimer, the term of this patent is extended or adjusted under 35 U.S.C. 154(b) by 531 days.

(21) Appl. No.: 12/708,790

(22) Filed: Feb. 19, 2010

(65) Prior Publication Data

US 2011/0208098 A1 Aug. 25, 2011

(51) Int. Cl.

| | |
|---|---|
| ***A63B 22/00*** | (2006.01) |
| ***A63B 23/08*** | (2006.01) |
| ***A61H 1/00*** | (2006.01) |
| ***A61H 1/02*** | (2006.01) |

(52) U.S. Cl.

USPC ..... 601/33; 601/27; 601/34; 482/70; 482/79

(58) Field of Classification Search ..... 601/23, 601/5, 27–35; 482/66, 70, 68, 79

See application file for complete search history.

(56) References Cited

U.S. PATENT DOCUMENTS

| | | | | |
|---|---|---|---|---|
| 4,229,001 | A * | 10/1980 | Roman | 482/79 |
| 5,606,751 | A | 3/1997 | Baker | |
| 6,270,445 | B1 | 8/2001 | Dean, Jr. et al. | |
| 7,901,336 | B2 * | 3/2011 | McDuffie | 482/79 |

OTHER PUBLICATIONS

Isokinetics, Shuttle mini press, http://www.isokineticsinc.com/category/minipress/product/ss_4100, Published on the internet at least as early as Feb. 10, 2010.

Ibex, In- Bed Exerciser, http://www.simbex.com/projects.htm#ibex, Published on the internet at least as early as Feb. 10, 2010.

ERMI, ERMI Knee/Ankle Flexionater, http://www.getmotion.com/pc_knee.htm#pr_anch, Published on the internet at least as early as Feb. 10, 2010.

The Furniss Corporation, Phoenix Knee CPM, http://www.kneecpm.com/phoenix.html, Published on the internet at least as early as Feb. 10, 2010.

Knee-Flex, The Knee-Flex Knee and Hip Exerciser, http://www.knee-flex.com/Knee-flex.html, Published on the internet at least as early as Feb. 10, 2010.

Joy Kasaaian and Sevan Abashian, Supine Leg Excerciser, http://www.bme.unc.edu/~rlg/rehabDesign/reports/2006/legExerciser.htm, Published on the internet at least as early as Feb. 10, 2010.

Margaret Gleave, Bed Loom, http://blog.modernmechanix.com/mags/PopularScience/7-1940/unique_bed.jpg, Published on the internet at least as early as Feb. 10, 2010.

Arthrofit, Step Challenger, http://stepchallenger.com/, Published on the internet at least as early as Feb. 10, 2010.

* cited by examiner

*Primary Examiner* — Nicholas Lucchesi
*Assistant Examiner* — Leah Stohr
(74) *Attorney, Agent, or Firm* — JMLS Patent Clinic; Michael James Tenuto

(57) ABSTRACT

A physical therapy device, in one form, provides rotation, flexion and stretching to rehabilitate patients undergoing physical therapy. The physical rehabilitation apparatus can comprise a base and a track coupled to the base with the track configured to slide along the base. The apparatus can further comprise a bearing coupled to the track, the bearing allowing rotational movement about an axis substantially perpendicular to the track and a tread coupled to the bearing. In one form, the apparatus works with a number of attachments.

16 Claims, 2 Drawing Sheets

1/2
17
40
42
50
44
17
65
60
64
66
62
63
80
72
12
30
20
67
90
13
11
10

80
60
40
72

80
60
130
40
50
72

80
60

17
200
40
50

17
150
40

PHYSICAL REHABILITATION APPARATUS

BACKGROUND OF THE INVENTION

The invention relates to physical rehabilitation tools, devices, equipment and methods for assisting persons in improving mobility and range of motion. More specifically, in one form, this invention relates to equipment which utilizes rotation, flexion and stretching to rehabilitate patients undergoing physical therapy. When older devices were in use, patients only had the ability to move appendages in one direction along a track, but this invention adds the ability to translate and rotate. This is a significant improvement, because it allows the body to move in a more natural way, which is believed to promote proper healing. Additionally, this embodiment works with a number of attachments. Older devices were limited to single use applications.

SUMMARY AND OBJECTS OF THE INVENTION

It is an object of this invention to provide patients with an apparatus that allows for the more natural movement of appendages during recuperative activity.

It is also an object of this invention to construct an apparatus that is adaptable for use in a variety of institutional and residential settings.

It is also an object of this invention to construct an apparatus that is adaptable in range of rotation, flexion, and stretching of appendages during recuperative activity.

It is also an object of this invention to construct an apparatus that is adaptable in the amount and application of resistance against motion and movement of appendages during recuperative activity.

It is also an object of this invention to provide a versatile base for many possible attachments to enhance the capabilities of the apparatus, and provide a single, convenient apparatus for multiple rehabilitation methods.

Another object of this invention is to provide a caretaker with the ability to easily facilitate recuperation of the patient. The invention should be accessible for use by partially ambulatory as well as non-ambulatory patients.

Additional objects and advantages of the invention will be evident from the description that follows, or may be learned by practice of the invention. The objects and advantages of the invention may be realized and obtained by the instruments and combinations particularly pointed out in the appended claims.

To achieve the foregoing objects, and in accordance with the invention as embodied and broadly described, herein is provided a physical rehabilitation apparatus.

In one form, the apparatus comprises a base having an upper surface and lower surface. The lower surface can include a friction-inducing structure. A track is coupled to the upper surface of the base, which provides movement along a horizontal plane. A bearing is coupled to the track, providing rotational movement relative to the base. The track can, for example, consist of slide rails attached to the base that removably and slidably connect to slide rails attached to the bearing.

In accordance with particular embodiments of the apparatus, attachments may be removably connected to the base, the track or the bearing. Attachments are adapted to perform varied types of exercises for the upper extremities or the lower extremities.

For example, a foot rest or tread may be pivotally coupled to the bearing, which allows the recuperating person to use the foot rest to push horizontally, and the bearing allows for rotation of the foot rest or tread by manipulation of the recuperating person's foot.

Also, attachments for use with the upper extremities may be coupled to the bearing. One attachment for the upper extremities consists of a hand crank. As the patient cranks the attachment, rotation about the bearing may allow flexion of muscles and rotation of the extremities about the joints of a patient. Another attachment consists of a sliding hand hold, which may help the patient develop flexibility and strength in the upper extremities. The person may push or pull horizontally, and the bearing allows for rotation about the joints in the person's upper extremities.

Additionally, an inclination attachment can also be provided to allow individuals to change the angle of the base relative to a supporting surface, the angle ranging from 0 to 90 degrees, thereby increasing the resistance, due to gravity, provided against movement along the track by a patient during operation of the apparatus.

DETAILED DESCRIPTION

Figure 1:
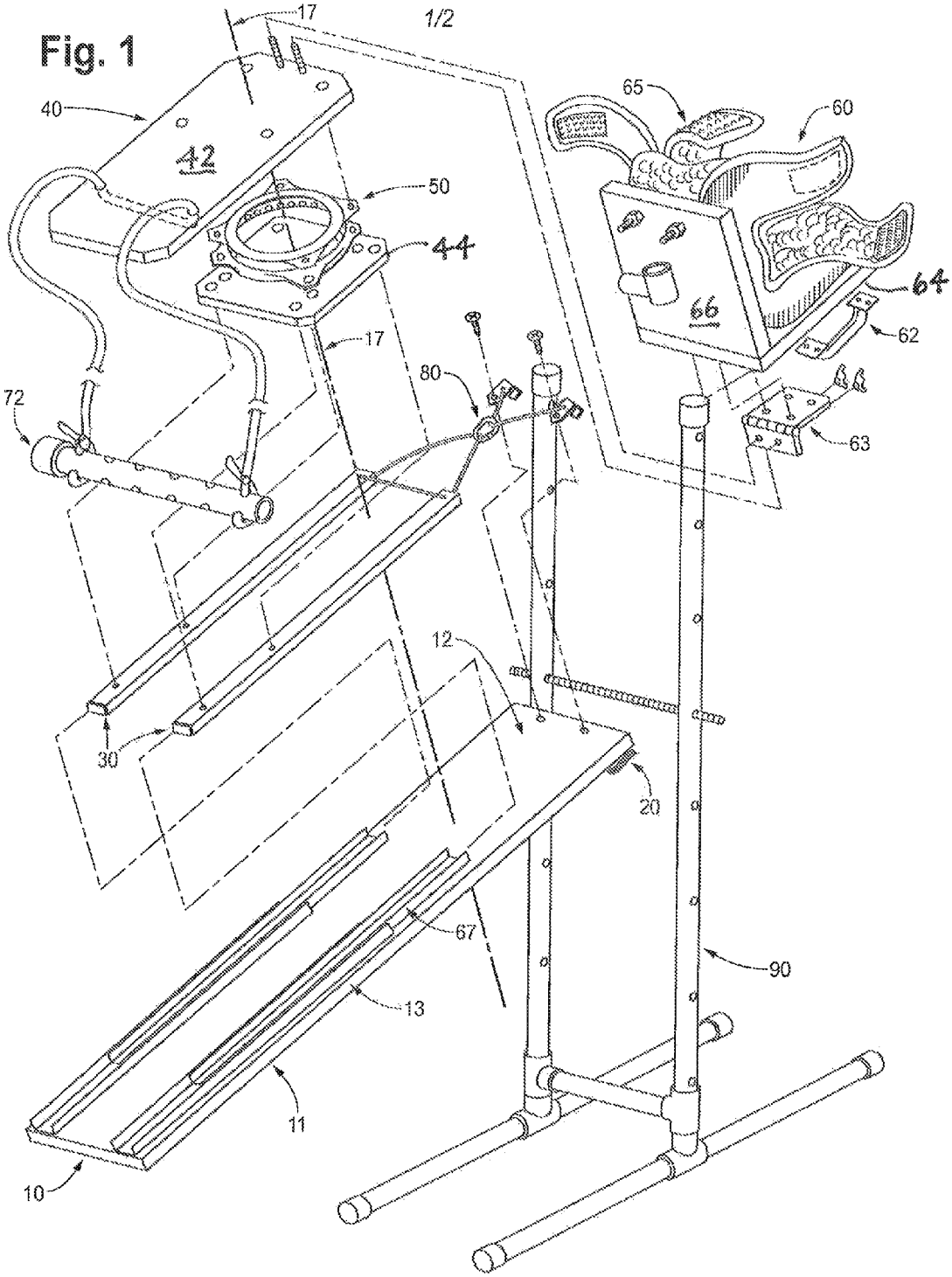
FIG. 1 is an exploded view of a physical rehabilitation apparatus according to the present invention.

Referring to FIG. 1, a base 10, has a lower surface 11. In one embodiment, the base 10 includes a board 13, or other structure having a flat surface. However, a flat surface is not required. For example, the lower surface 11 could be comprised of one or more legs.

A friction-inducing structure 20 can be included on the lower surface 11 to help prevent the apparatus from moving during operation. The friction-inducing structure 20 can assist the patient in using the apparatus on surfaces such as linoleum floors, waxed wooden floors, bed sheets, blankets, comforters or quilts, by providing stability on an otherwise somewhat slippery surface.

The base also includes an upper surface 12. The upper surface 12 of the base is coupled to a track 30, which in one form can be substantially flat. The track 30 preferably provides a smooth, even, and durable system for translating kinetic energy into longitudinal motion. In the depicted embodiment, the track 30 is similar to the heavy-duty slides used for the drawers of filing cabinets, tool cabinets, some dressers and other similar applications. However, it is important to note that the track 30 is not limited to the depicted embodiment. Any form of suitable track could be used, such as those used for monorails, overhead cranes, telescopes, or other conveyances.

The track 30 is coupled to a platform 40. The platform 40 includes an upper member 42 and a lower member 44. The platform 40 preferably slides horizontally along the length of the track 30. The platform 40 preferably provides a stable surface for subsequent placement of additional components of the apparatus on top of the track 30.

The platform 40 is coupled to a bearing 50. For example, as shown in FIG. 1, the bearing 50 is disposed between the upper member 42 and the lower member 44 of the platform 40. The bearing 50 rotates clockwise and counter-clock wise about an axis 17 substantially perpendicular to the base 10. The bearing 50 may come in various embodiments, ranging from a simple peg to a series of concentric cylinders or spheres. The bearing 50 allows rotation about an axis 17 as explained hereafter or rotation about an axis in some other manner.

Figures 2, 3, 4, 5, 6:
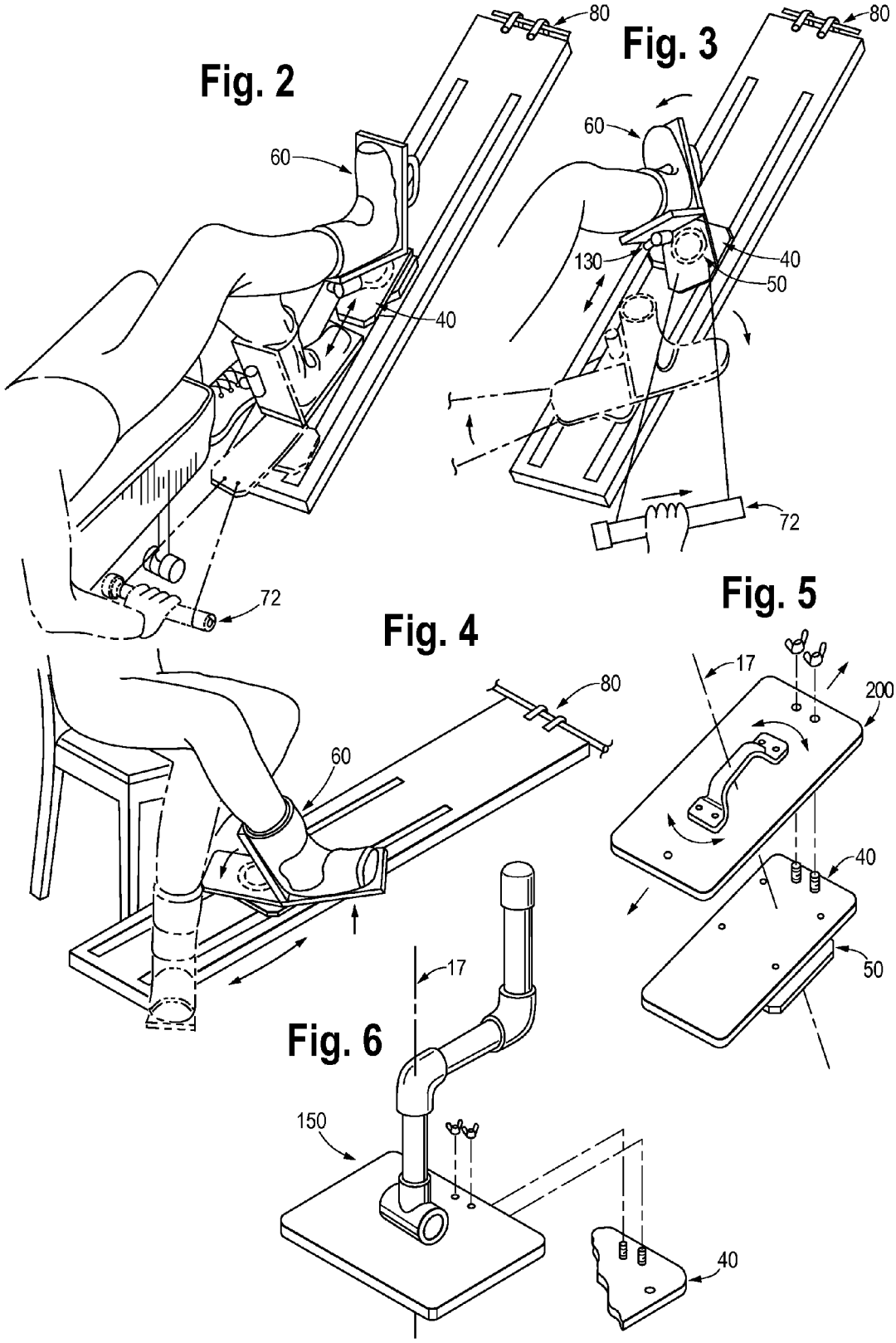
FIG. 2 is a perspective view of the physical rehabilitation apparatus in use from a reclining position.
FIG. 3 is a perspective view of the physical rehabilitation apparatus during rotation and translation of the tread along the tracks.
FIG. 4 is a perspective view of the physical rehabilitation apparatus in use from a sitting position.
FIG. 5 is an exploded view of a grip attachment.
FIG. 6 is a partial exploded view of a hand crank attachment.

Further, referring to FIG. 3, the bearing 50 is shown with its rotational capability, and the platform 40 is shown coupled to the track 30, with the capability of sliding along the length of the track 30. FIG. 4 further highlights these relationships.

Referring to FIG. 1, the bearing 50 is depicted as coupled to a tread 60. The tread 60 is able to move rotationally, via the bearing 50, and horizontally, through sliding the bearing 50 along the length of the track 30. In one embodiment, as depicted in FIG. 1, the tread 60 includes a first member 64 and a second member 66. For example, suppose the tread 60 is a rehabilitation boot, the first member 64 may be the sole of the boot and the second member 66 may be the back of the boot. In another embodiment, other types of tread 60 may be used to accommodate other physical rehabilitation exercises (to be described further starting paragraph [0037]).

However, other suitable forms of the tread 60 may include structures such as a boot or other foot-confining device that can accommodate a foot from the patient. The boot may have lashes, latches, Velcro straps or buckles that help maintain the stability of the foot while operating the apparatus. Referring to FIG. 1, in one form, the Velcro straps 65 can allow a patient or caretaker to easily secure the foot of the patient to the tread 60 in a durable and comfortable manner.

The tread 60 is coupled to a handle 62. The handle 62 provides a caretaker the ability to manipulate the tread 60 while a patent operates the apparatus. Patients with severe restrictions upon their mobility receive assistance from caretakers during operation of the apparatus. This increases the safety and efficacy of the apparatus.

A hinge 63 is coupled to the tread. The hinge 63 provides the tread 60 with an additional degree of movement. Using the hinge 63, a patient can move his lower appendage toward or away from the platform 40, through a 90 degree arc. This increases the ability to engage in presumably recuperative movement.

Also, the tread 60 is coupled to a rope 72. The rope allows a patient to use an alternate force to control the motion of the appendage in the tread as it traverses the track. For patients with physical limitations on the flexion, strength, or range of motion, the rope 72 assists the patient or the caretaker with operating the apparatus.

Additionally, the tread 60 is coupled to a knee lock prevention device 130. The knee lock prevention device prevents the tread 60 from touching the platform 40, thereby preventing the complete flexion of the leg, which may cause a knee to lock in an immobile patient with reduced flexion and mobility.

Another safety feature of the apparatus is the existence of stops 67. Stops 67 allow the patient or caretaker to limit the horizontal motion of the apparatus, to avoid injury or discomfort during use of the apparatus. The stops 67 prevent the platform 40 from traversing the entire length of the track 30, but the stops 67 do not prevent the natural movement of the patient's appendage. The patient is still able to move the appendage within the tread 60 about the axis 17, which the bearing 50 allows.

Additionally, the stops 67 provide a mechanism for adjusting the position of the platform 40, in relation to the track 30, which allows greater stability during particular applications, such as when a patient is standing while operating the apparatus. In the prior art, machines that had the ability to move appendages lengthwise along a track, but did not have the capability of locking in place and using rotation to improve the recovery of a patient.

In one embodiment, a frame 90 allows the apparatus to vary in angular relation to a surface supporting the patient. A resistance adjuster 80 secures the base 10 in place once the patient (or caretaker) has established his preferred confirmation for operation. Once the angle of the base 10 is shifted in relation to a floor or a bed, the resulting incline uses the force of gravity to alter the resistive effect of the apparatus. The base 10 may be adjusted via the resistance adjuster 80 to range from flat to vertical, in relation to the bed or floor.

While the physical rehabilitation apparatus has been illustrated as above, there may be many variations on the basic embodiment shown. For example, in one form, the bearing can be a semi-circular ball-in-socket connection between the track and the tread, to provide rotation about an axis perpendicular to the base, with an additional range of motion allowing a plane formed by the bottom of the tread to range from substantially parallel to the plane formed by the surface of the base to substantially perpendicular to the plane formed by the surface of the base. (Not shown in figures.)

In one form, the physical rehabilitation apparatus allows the addition of other exercise functions to the basic structure. Generally, the other exercise functions can require the base to be positioned either flat on a support surface such as a bed, floor, or table, or at a 90 degree angle to the support surface. For example, one form comprises a hand crank 150 coupled to the bearing 50. The hand crank 150 allows the patient to use the apparatus for improving the rotation, flexion and stretching capabilities of upper appendages. The base can be positioned either flat or 90 degrees relative to a support structure, and the platform can be locked in place to resist moving along the track. Locking the apparatus thereby provides stability for the hand crank 150 while allowing rotation of the hand crank 150 and the upper appendages about an axis 17.

Another form comprises a grip 200 coupled to the bearing. The grip 200 allows the patient to push or pull the bearing along the track, while simultaneously rotating the bearing around the axis 17. The grip 200 allows the patient to improve dexterity, rotation, and flexion of the upper appendages, joints, and phalanges. Similar to the example above, when using the grip 200, the base can be positioned either flat or 90 degrees relative to a support structure. When in use, the motion of the grip can be similar to the physical motion of an iron along a garment. The grip can rotate about an axis 17, while simultaneously translating along the length of the track 30.

In use, the physical rehabilitation apparatus provides a number of improvements over older devices. The ability to translate kinetic energy into longitudinal motion and rotational motion simultaneously presents a number of benefits. It allows a patient or caretaker to better approximate a natural range of motion. For example, the physical rehabilitation apparatus may be operated while positioned parallel to the body of the patient, or it may be positioned in a confirmation that is horizontal to the body of the patient. It also allows the patient or caretaker to use the apparatus for a wider range of applications or areas of focus.

The physical rehabilitation apparatus also allows the patient or caretaker to use the device in a number of settings, both institutional and residential. For example, the physical rehabilitation apparatus may be used by a patient as the patient is lying down, seated, or in a semi-reclined position.

The physical rehabilitation apparatus may be on a floor or table, while the patient remains seated in a chair or lying on a bed. The additional ranges of motion granted by the bearing and the hinge are believed to increase the overall versatility, flexibility, and applicability of the apparatus as used for recuperative purposes.

The resistance adjuster provides the ability to increase the required exertion used by the patient to operate the apparatus. Increasing the resistance may assist in building strength and flexibility during the recuperative process. It should be noted that when older devices were in use, a patient needed to rely upon a caretaker or therapist to provide additional resistance. Although a caretaker may assist in using this apparatus, such assistance may often prove unnecessary.

Furthermore, the apparatus allows a caretaker to have additional treatment options. The apparatus may be optimized for the condition of the individual patient. The stops may be employed to prevent hyperextension or unwanted exertion. The resistance to any individual form of motion may be adjusted to a level deemed appropriate. The handle on the tread may be used to assist the patient in moving translationally or rotationally. The rope also provides a caregiver or patient with a way to augment the patient's own physical exertion during operation of the apparatus. When other attachments are in use, the caregiver can guide the patient's movement by manipulating the patient's appendages or the attachments themselves.

It will be appreciated that the invention provides a versatile, multifunctional exercise structure of convenient readily constructed design. Additionally, although the structure may be manufactured predominantly in metal and wood, the design lends itself to having significant portions molded in plastic or composed of rubber. The above is only illustrative of the principles of the invention, and is not to be construed as limiting the invention to the exact construction and operation shown and described. Accordingly, all suitable modifications and equivalents will fall within the scope of the invention. All changes which come within the range and meaning of equivalency of the claims are embraced within their scope.

I claim:

1. A physical rehabilitation apparatus comprising:

a base;

a track coupled to the base, the track configured to slide along the base;

a platform coupled to the track;

a bearing coupled to the platform, the bearing allowing rotational movement about an axis substantially perpendicular to the track;

a tread having a first member and a second member, said first member coupled to the platform; and a hinge coupled to the first member of the tread and the platform such that the tread being pivotally coupled to said platform, said hinge being disposed adjacent to the second member, said hinge providing an additional movement through a 90 degree arc to the tread.

2. A physical rehabilitation apparatus as recited in claim 1, wherein the base has an upper and lower surface, the lower surface including a friction-inducing structure.

3. A physical rehabilitation apparatus as recited in claim 1 wherein the bearing is removably coupled to a platform.

4. A physical rehabilitation apparatus as recited in claim 1 wherein a rope is coupled to the platform.

5. A physical rehabilitation apparatus as recited in claim 1 wherein.

6. A physical rehabilitation apparatus as recited in claim 1, wherein the track further comprising stops to lock the bearing at a desired location with respect to the track.

7. A physical rehabilitation apparatus as recited in claim 1, wherein the bearing is removably attached to the track.

8. A physical rehabilitation apparatus as recited in claim 1 wherein a knee lock prevention device is coupled to the second member of the tread.

9. A physical rehabilitation apparatus as recited in claim 6, further comprising a hand crank coupled to the platform, wherein the locking mechanism along the track facilitates use of the hand crank.

10. A physical rehabilitation apparatus comprising:

a base;

a track coupled to the base, the track configured to slide along the base;

a platform coupled to the track;

a bearing coupled to the platform, the bearing allowing rotational movement about an axis substantially perpendicular to the track, wherein the bearing is rotatable clockwise and counter-clockwise about an axis substantially perpendicular to the base, wherein the bearing is pushed or pulled to facilitate rotation;

a tread having a first member and a second member, said first member coupled to the platform; and a hinge coupled to the first member of the tread and the platform such that the tread being pivotally coupled to said platform, said hinge being disposed adjacent to the second member, said hinge providing an additional movement through a 90 degree arc to the tread; and a frame, the frame coupled to the base, wherein the frame provides stability to the physical rehabilitation apparatus.

11. A physical rehabilitation apparatus as recited in claim 10 wherein the base has an upper and lower surface, the lower surface including a friction-inducing structure.

12. A physical rehabilitation apparatus as recited in claim 10 further comprising a resistance adjuster, wherein the resistance adjuster allows the base to vary angularly in relation to a support structure.

13. A physical rehabilitation apparatus as recited in claim 10, wherein the track further comprising stops to lock the bearing at a desired location with respect to the track.

14. A physical rehabilitation apparatus as recited in claim 10, wherein a knee lock prevention device is coupled to the second member of the tread.

15. A physical rehabilitation apparatus as recited in claim 10, wherein said frame coupled to a resistance adjuster; the resistance adjuster coupled to the base, wherein the resistance adjuster is angularly adjustable relative to the frame, thereby providing angular adjustment to the base relative to the frame.

16. A physical rehabilitation apparatus as recited in claim 10, further comprising a handle coupled to the first member of the tread, wherein the handle facilitates movement of the tread along the length of the track.

* * * * *